US010918248B2

(12) United States Patent
Ford et al.

(10) Patent No.: US 10,918,248 B2
(45) Date of Patent: Feb. 16, 2021

(54) SURFACE CLEANING APPARATUS

(71) Applicant: Midea America Corp., Medford, MA (US)

(72) Inventors: Thomas D. R. Ford, Wellesley, MA (US); Meng Sum, Suzhou (CN); Wai Jun Ho, Somerville, MA (US)

( * ) Notice: Subject to any disclaimer, the term of this patent is extended or adjusted under 35 U.S.C. 154(b) by 312 days.

(21) Appl. No.: 16/149,915

(22) Filed: Oct. 2, 2018

(65) Prior Publication Data

US 2019/0274499 A1 Sep. 12, 2019

Related U.S. Application Data

(60) Provisional application No. 62/641,107, filed on Mar. 9, 2018.

(51) Int. Cl.
*A47L 5/22* (2006.01)
*A47L 9/02* (2006.01)
(Continued)

(52) U.S. Cl.
CPC ..... *A47L 5/225* (2013.01); *A47L 5/26* (2013.01); *A47L 5/30* (2013.01); *A47L 5/32* (2013.01);
(Continued)

(58) Field of Classification Search
CPC . A47L 5/225; A47L 9/246; A47L 5/32; A47L 5/30; A47L 5/26; A47L 9/0036;
(Continued)

(56) References Cited

U.S. PATENT DOCUMENTS 5,054,157 A * 10/1991 Werner ..... A47L 5/362 15/328
5,524,321 A * 6/1996 Weaver ..... A47L 5/225 15/323

(Continued)

FOREIGN PATENT DOCUMENTS

WO 2005084511 A1 9/2005
WO 2010102410 A1 9/2010
WO 2017186280 A1 11/2017

OTHER PUBLICATIONS

International Search Report and Written Opinion of the International Searching Authority for International Application No. PCT/US2018/053969, entitled: "Surface Cleaning Apparatus", dated Dec. 2, 2019.

*Primary Examiner* — David Redding
(74) *Attorney, Agent, or Firm* — Kilpatrick Townsend & Stockton, LLP

(57) ABSTRACT

A vacuum cleaner that can quickly be configured in various operating modes, including a standard-style upright vacuum, upright vacuum capable of cleaning under furniture, stick vacuum, handheld vacuum, and pod vacuum. An example embodiment is a surface cleaning apparatus that includes an elongated support member, a handle coupled to an upper end of the elongated support member, a vacuum module slidably and detachably coupled to the elongated support member, and a hose coupled to the vacuum module and expandable to accommodate lower and upper positions of the vacuum module along the elongated support member. The surface cleaning apparatus can further include a floor nozzle detachably coupled to a lower end of the elongated support member and the hose.

23 Claims, 12 Drawing Sheets

(51) Int. Cl.

| | |
|---|---|
| ***A47L 9/24*** | (2006.01) |
| ***A47L 5/32*** | (2006.01) |
| ***A47L 5/30*** | (2006.01) |
| ***A47L 5/26*** | (2006.01) |
| ***A47L 9/00*** | (2006.01) |
| ***A47L 7/00*** | (2006.01) |
| ***A47L 9/04*** | (2006.01) |

(52) U.S. Cl.
CPC ..... *A47L 7/0076* (2013.01); *A47L 9/0036* (2013.01); *A47L 9/02* (2013.01); *A47L 9/0477* (2013.01); *A47L 9/244* (2013.01); *A47L 9/246* (2013.01); *A47L 9/248* (2013.01)

(58) Field of Classification Search
CPC ..... A47L 9/244; A47L 7/0076; A47L 9/0477; A47L 9/02; A47L 9/248
See application file for complete search history.

(56) References Cited

U.S. PATENT DOCUMENTS

| | | | | |
|---|---|---|---|---|
| 6,094,775 | A | 8/2000 | Behmer | |
| 7,377,007 | B2 * | 5/2008 | Best | A47L 9/1683 15/329 |
| 2014/0259518 | A1 | 9/2014 | Conrad | |

* cited by examiner

SURFACE CLEANING APPARATUS

RELATED APPLICATION(S)

This application claims the benefit of U.S. Provisional Application No. 62/641,107, filed on Mar. 9, 2018. The entire teachings of the above application are incorporated herein by reference.

BACKGROUND

Vacuum cleaners are useful for cleaning surfaces, such as floors, upholstery, and stairs. Most vacuum cleaner styles for a consumer's use are lighter than in the past and are configured in an upright or handheld style.

SUMMARY

Disclosed herein are surface cleaning apparatus that, according to example embodiments, enable a user to adjust a height of a vacuum module along a frame rail, or other component (e.g., shaft, pole), of a vacuum cleaner. While the vacuum module is in a lowest position of the frame rail, the vacuum cleaner is configured as a standard-style upright vacuum cleaner. While the vacuum module is at an elevated position along the frame rail, the vacuum cleaner has a profile that provides for easier access under furniture, for example. The vacuum module may also be decoupled from the frame rail, enabling use as a stick vacuum, handheld vacuum, or pod vacuum.

One example embodiment is a surface cleaning apparatus that includes an elongated support member, a handle coupled to an upper end of the elongated support member, a vacuum module slidably and detachably coupled to the elongated support member, and a hose coupled to the vacuum module and expandable to accommodate lower and upper positions of the vacuum module along the elongated support member.

The surface cleaning apparatus can further include a floor nozzle detachably coupled to a lower end of the elongated support member and the hose. In some embodiments, the hose can include an electrical component configured to power the floor nozzle. The electrical component can be embedded in the hose, such as around ribs of the hose, or can be attached to the outside of the hose. The floor nozzle can include a neck that includes an electrical connector to connect to the electrical component of the hose.

The vacuum module can include a receptacle configured to retain the hose when the hose is retracted. When the vacuum module is configured in its lowest position along the elongated support member, the hose can be retracted and retained within the receptacle of the vacuum module. When the vacuum module is detached from the elongated support member and the apparatus is in a handheld vacuum configuration, the hose can be retracted and retained within the receptacle of the vacuum module. When the apparatus is in a pod vacuum configuration, the vacuum module can be detached from the elongated support member and the hose can be expanded.

The elongated support member can be extendable and retractable. In such embodiments, the elongated support member can include multiple components that slide into each other. The vacuum module can be coupled to an upper surface of the elongated support member, which can allow the elongated support member to be positioned parallel or near parallel to a surface to, for example, reach under furniture.

The elongated support member can include a frame rail, and the frame rail and vacuum module can include complementary features that enable the vacuum module to couple to the frame rail. The frame rail and vacuum module can include further complementary features to enable positioning of the vacuum module at different locations along the frame rail (e.g., a lower position, upper position, and intermediate positions). The frame rail can include a track and a rail guide mechanism slidably disposed within the track, and the rail guide mechanism and vacuum module can include complementary features to enable the vacuum module to couple to the rail guide mechanism in a manner that does not restrict the rail guide mechanism from being capable of sliding within the track. Such a track and rail guide mechanism can include complementary features that enable the rail guide mechanism to be fixedly positioned at multiple locations along the track.

Some embodiments can include a collar assembly coupled to the elongated support member and can include at least one feature that enables the vacuum module to couple to the collar assembly. The elongated support member and collar assembly can include complementary positioning features that enable the collar assembly to be fixedly positioned at multiple locations along the elongated support member.

The vacuum module can include a handle, air treatment unit, dust cup, suction motor, filter, cyclone chamber, and hose interface. The vacuum module can further include a mechanism that enables the vacuum module to be attachable and detachable from the elongated support member or interface element coupled to the elongated support member.

Another example embodiment is a cleaning apparatus that includes an elongated support member, a handle configured to be coupled to the elongated support member, a vacuum module configured to be slidably coupled to the elongated support member, and a hose configured to be coupled to the vacuum module and expandable to accommodate different positions of the vacuum module along the elongated support member.

Another example embodiment is a cleaning apparatus that includes a support structure and a vacuum module detachably coupled to the elongated support member. The support structure includes an elongated support member, a handle coupled to an upper end of the elongated support member, and a floor nozzle pivotably coupled to a lower end of the elongated support member and having a dirty air inlet and a dirty air outlet. The vacuum module includes a body with a handle and that is configured to attach to the support structure. The vacuum module further includes an air path having a dirty air inlet cuff, a flexible air conduit, an air treatment member, a suction motor, and a clean air outlet. The air path is configured to attach to the dirty air outlet of the floor nozzle. When the vacuum module is attached to the support structure, the floor nozzle dirty air outlet is fluidly connected to the vacuum module dirty air inlet cuff. When the vacuum module is detached from the support structure, the vacuum module is operable as a handheld vacuum and the dirty air inlet cuff of the air path can be configured to couple with accessory tools. When the vacuum module is detached from the support structure, the vacuum module and extended hose are operable as a pod vacuum with flexible air conduit hose. When the vacuum module is slidably mounted on the support structure, the dirty air inlet cuff can be attached to the floor nozzle, and the flexible air conduit hose can extend to the body of the vacuum module.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1D:
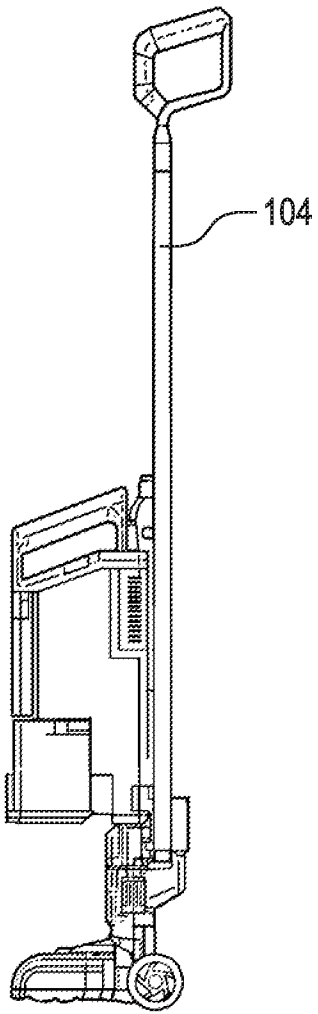
FIGS. 1A-D are diagrams of an example vacuum cleaner, according to an example embodiment.
Figure 1C:
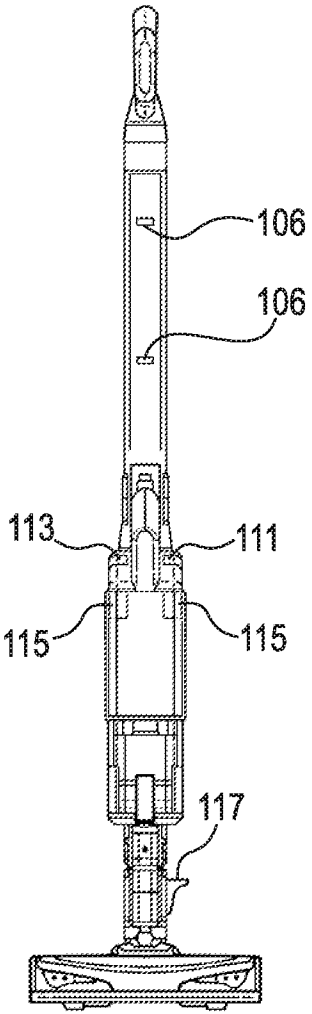

A description of example embodiments follows.

Generally, the embodiments disclosed herein provide a vacuum cleaner that can quickly be configured in various operating modes, including standard-style upright vacuum, upright vacuum capable of cleaning under furniture, stick vacuum, handheld vacuum, and pod vacuum.

Referring to FIGS. 1A-1D, one example embodiment of a surface cleaning device provides an upright vacuum cleaner 100 that can include a handle 102 that is coupled to one end of an elongated support member (e.g., rigid frame rail 104). The opposite end of frame rail 104 can be coupled to a nozzle neck 126 that can be releasably attached to a floor nozzle 122 or other attachment. One or more indentations or slots 106 can be disposed on a planar surface of the frame rail 104. Both outside edges of the frame rail 104 can be configured to be higher than the planar surface and to overhang the planar surface slightly, thereby forming a track or groove in which a rail guide mechanism (see FIG. 4C, item 405) can be housed. The vacuum module 108 can be attached to the rail guide mechanism so that the vacuum module 108 can be selectively positioned along the length of the frame rail 104 by selecting the appropriate slot 106 as a fixed stop. Also, the vacuum module 108 can be releasably attached to the rail guide mechanism so that the vacuum module 108 can be detached entirely and used independently as a handheld vacuum or pod vacuum. The rail guide mechanism can include a lever or button 120 that can be utilized to attach and detach the vacuum module 108 to the frame rail 104. Another lever or button 118 on the rail guide mechanism can be utilized to allow the vacuum module 108, while affixed to the rail guide mechanism, to slide along the frame rail 104 to a preferred position as defined by a selected slot 106.

The vacuum module 108 can be a standalone complete vacuum cleaner system having a handle 110, an air treatment unit 304 (FIG. 3B), a dust cup 112, a dust cup door 116, a door latch 114, power source, on/off button 111, post-motor filter cover 308 (FIG. 3D), pre-motor filter cover 121 with one or more buttons 115 for quick release. Additional buttons 113 can be provided to enable various functions and features, such as, for example, adjusting speed of a brushroll, selecting between carpet or hard-floor settings, communicating with a motor controller or actuator to change nozzle functions, etc. The vacuum module 108 can also include an expandable hose 208 with a hose cuff or connector 212 (FIGS. 2A-2D). The vacuum module 108 can be a component of an upright vacuum cleaner 100 (as shown in FIGS. 1A-1D, 2A, 2B), or it can be a standalone vacuum cleaner, such as, a handheld vacuum (i.e., "handvac") 204, as shown in FIG. 2C, or pod vacuum 206, as shown in FIG. 2D.

The vacuum cleaner 100 can also include a swivel joint 124 coupled between the floor nozzle 122 and the nozzle neck 126. The swivel joint 124 allows the vacuum cleaner to be pivotably mounted thereby providing the vacuum cleaner 100 with a wider range of motion in various directions. The nozzle neck 126 can include a lever or button 117 that can be engaged to remove the nozzle 122 from the vacuum cleaner 100. In various embodiments, the nozzle 122 can include various components including a brushroll, brushroll motor, and headlights.

Referring to FIGS. 2A-2D, four example additional modes of operation are depicted. In an upright embodiment 200, the vacuum module 108 can include an expandable hose 208 that, in some embodiments, is housed within the vacuum module 108 while the vacuum module 108 is in a lowest position along the frame rail, and is partially housed within the vacuum module 108 when the vacuum module 108 is away from the lowest position. The expandable hose 208 may include a hose cuff or connector 212 that can be coupled to the nozzle neck 126. In some embodiments, the expandable hose 208 can be electrified by embedding wires or conductive material within the hose 208 or along the exterior of hose 208. The expandable hose 208 does not need to be electrified, but oftentimes, an electrified hose can be useful for powering the floor nozzle 122 and any of its components, such as a brushroll or headlights (not shown). As illustrated in FIG. 2A, the vacuum module 108 can be affixed at the top of the frame rail 104 via the rail guide mechanism and selectable slots 106, as described above, and, as the vacuum module 108 is slid up the frame rail 104 to its selected position, the hose 208 expands along the length of the lower frame rail 104. This configuration 200 and mode of operation has the advantage of allowing a user to reach deep under furniture and hard-to-access places with the vacuum cleaner.

In another configuration 202 (FIG. 2B), the vacuum module 108 can be affixed near the top of the frame rail 104, and the expandable hose 208 can be extended along the frame rail 104, but, in this configuration 202, the floor nozzle 122 and nozzle neck 126 can be removed via a respective lever 117. This configuration 202 and mode of operation has the advantage of allowing a user to reach high places overhead and hard-to-access places.

In another configuration 204 (FIG. 2C), the vacuum module 108 can be configured as a standalone handheld vacuum cleaner (i.e., handvac) with the expandable hose 208 retracted within the vacuum module 108. In another configuration 206 (FIG. 2D), the vacuum module 108 can be configured as a pod vacuum, which is convenient for cleaning cars, underneath car seats, and other hard to-access places. The vacuum module 108 can include a strap 210, clip, snap, hook, latch, catch, or other fastening mechanism that can hold the expandable hose 208 in place within the vacuum module 108 until needed.

Figures 3A, 3B, 3C, 3D:
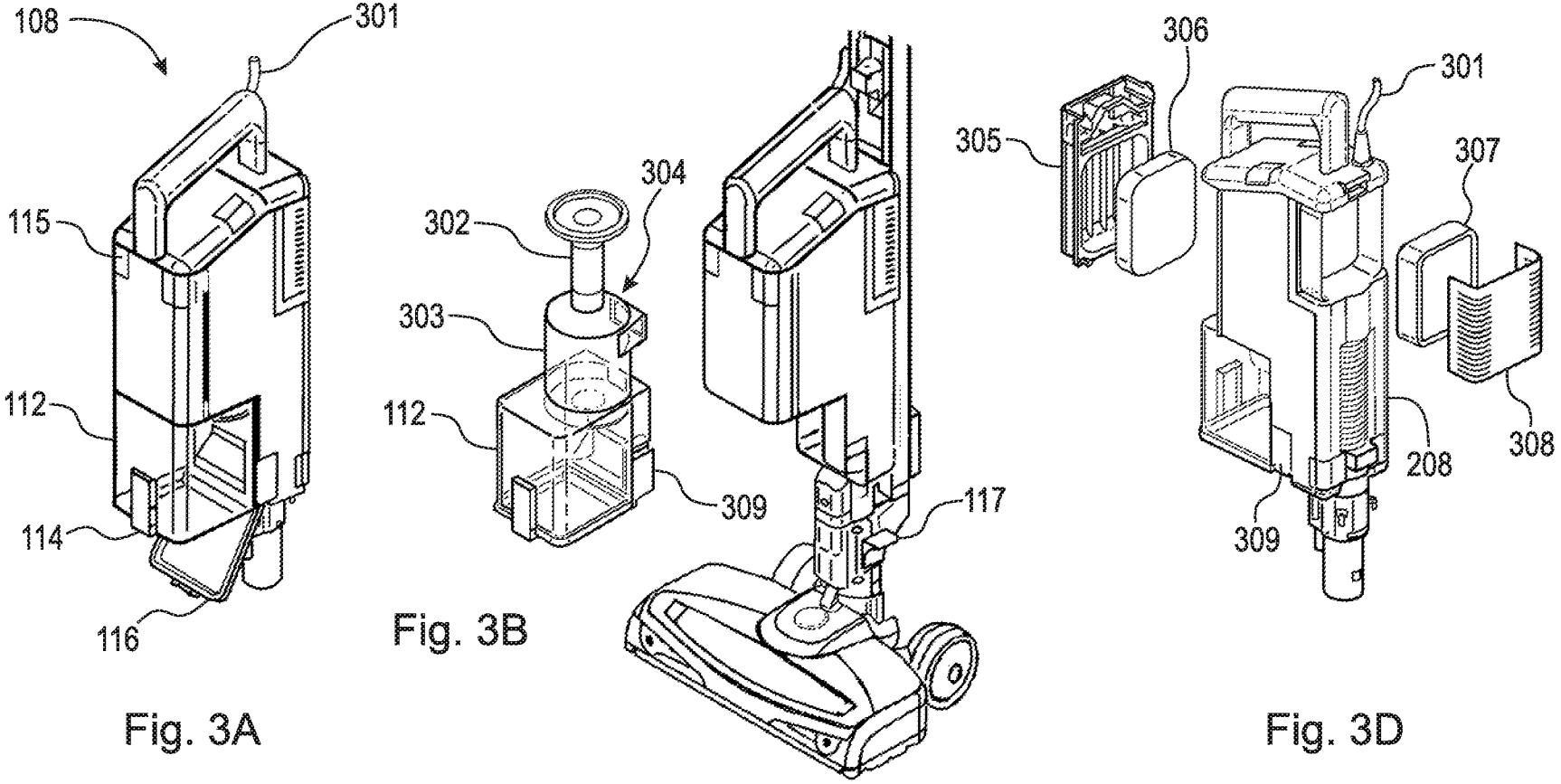
FIGS. 3A-D are diagrams of an aspect of the embodiment of FIGS. 1A-D during emptying and maintenance activities by a user.

Referring to FIGS. 3A-3D, the vacuum module 108 can be configured as a corded or cordless unit. In other embodiments, the vacuum module 108 can include both a power cord 301 for corded operation and a battery pack (see FIG. 7, item 701) for cordless operation. During normal operation, the dust cup 112 can be emptied by simply opening the dust cup door 116 via the latch 114. In addition, the vacuum module 108 can include a button 309 that can be utilized to remove the dust cup 112 and air treatment unit 304 entirely from vacuum module 108 for maintenance purposes. In FIG. 3B, the air treatment unit 304 is depicted as a single cyclone chamber having a vortex finder 302 and a housing 303. In other embodiments, the air treatment unit 304 can be configured as a horizontally or vertically positioned single cyclone, dual cyclone, multi-cyclone, or any other type of air treatment or filtration unit.

The vacuum module 108 can also include one or more primary and secondary filters (e.g., cartridge filter, cloth filter, foam filter, disk filter, allergen filter, wet/dry filter, scented filter, high-efficiency particulate air (HEPA) filter). For example, vacuum module 108 can include a pre-motor filter 306 that is positioned in a housing cover 305, and the pre-motor filter 306 can be foam filter selected to remove most dust and dirt particles from an introduced air flow before the air flow enters a motor (not shown) located in the vacuum module 108. In addition, a post-motor filter 307 can be positioned after the motor and under a housing cover 308. The post-motor filter 307 can be a HEPA filter, which filters out small particles from an introduced air flow, before the filtered air flow exits vacuum module 108 and is discharged into the environment.

Figure 4C:
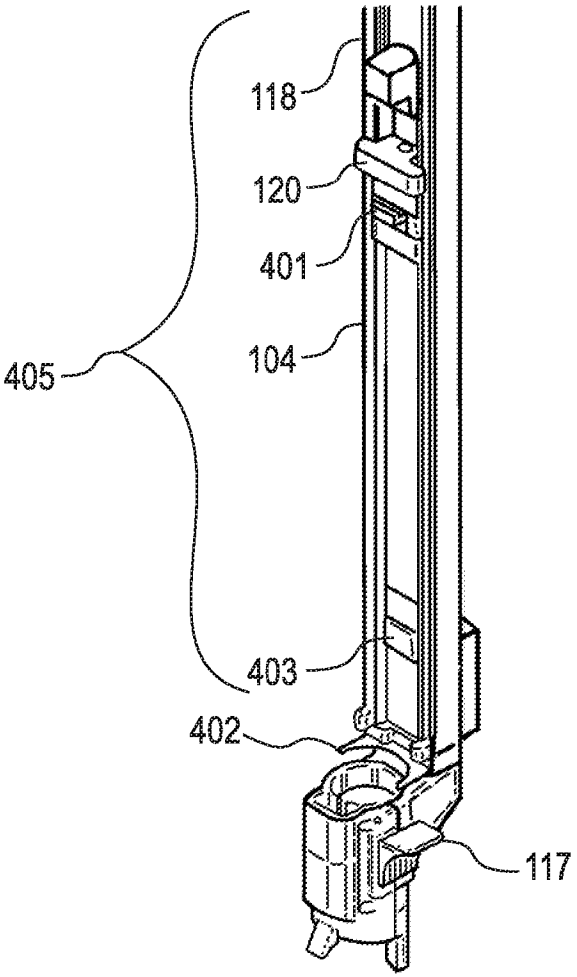
FIGS. 4A-C are diagrams of an aspect of the embodiment of FIGS. 1A-D that enables sliding of a vacuum module along a frame rail to change a profile of the vacuum cleaner.
Figure 4B:
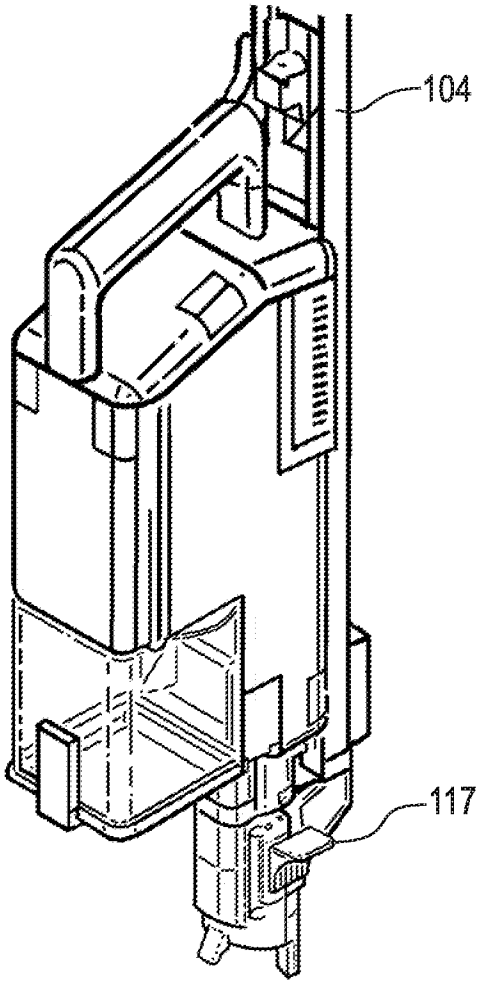
Figure 4A:
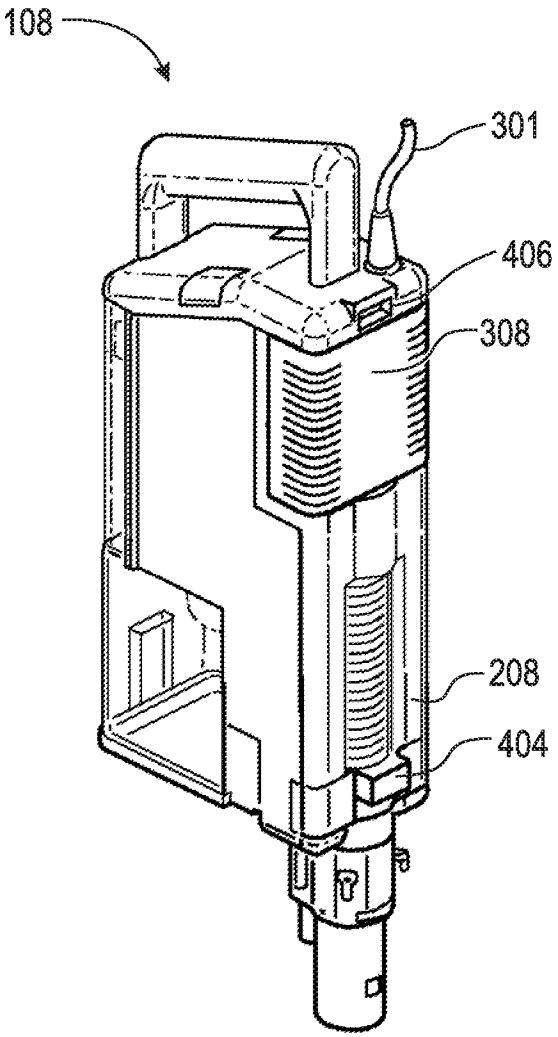

Referring to FIGS. 4A-4C, in an example embodiment, the rail guide mechanism 405 is in a coupled arrangement with the frame rail 104. The rail guide mechanism 405 can be housed on the frame rail 104, and the raised overhanging edges of the frame rail 104 prevent the rail guide mechanism 405 from dislodging. The rail guide mechanism 405 can slide along the entire length of the frame rail 104, and can be selectively positioned via slots 106 at various locations along the frame rail 104. The rail guide mechanism 405 can include catches 401 and 403 that can interlock with corresponding vacuum module 108 catches 406 and 404, respectively, thereby releasably attaching the vacuum module 108 to the rail guide mechanism 405. This configuration enables the vacuum module 108 to slide with the rail guide mechanism 405 along the frame rail 104 to a selected position defined by a particular slot 106. As described below, the rail guide mechanism 405 can include a lever or button 120 to facilitate in detaching the vacuum module 108 from the rail guide mechanism 405, and another lever or button 118 can be included to facilitate attaching and detaching the rail guide mechanism 405 from the slots 106.

The frame rail 104 can include a catch 402 that secures the hose cuff 212 end of the expandable hose 208 in place against the frame rail 104, thereby allowing the hose 208 to expand along and against the frame rail 104 as the vacuum module 108 is slid into position at a selected slot 106. Similarly, the catch 402 can hold the expandable hose 208 in place as the vacuum module 108 is lowered on the frame rail 104 to a standard-style upright vacuum position, thereby allowing the expandable hose 208 to recoil into the vacuum module 208 in a controlled manner. As discussed below, a lever or button, such as button 120, can be configured to facilitate disengaging the catch 402 from the expandable hose 208 when the vacuum module 108 is lowered to the standard-style upright vacuum position.

Figure 5C:
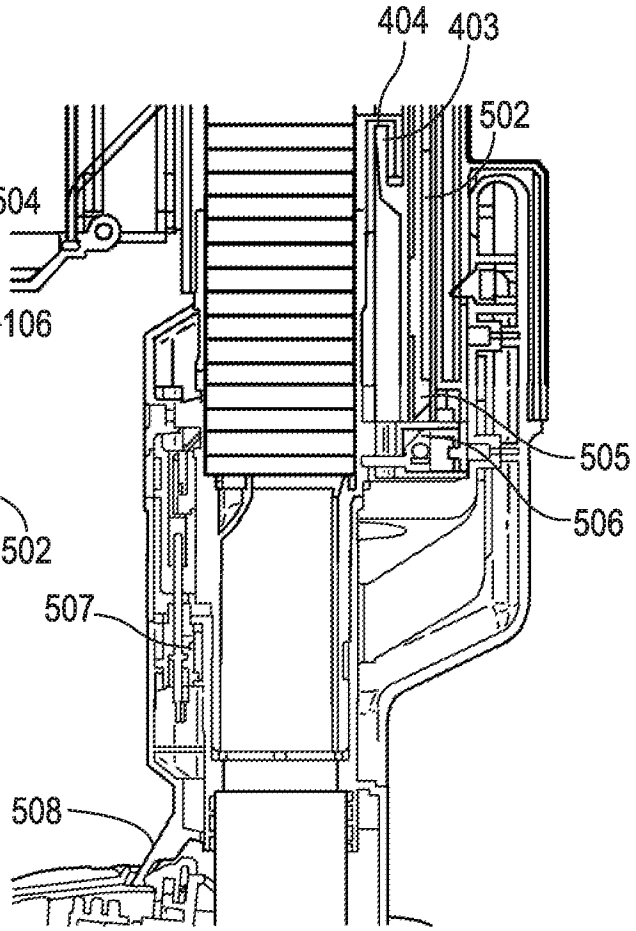
FIGS. 5A-G are views of aspects of the embodiment of FIGS. 1A-D.
Figure 5B:
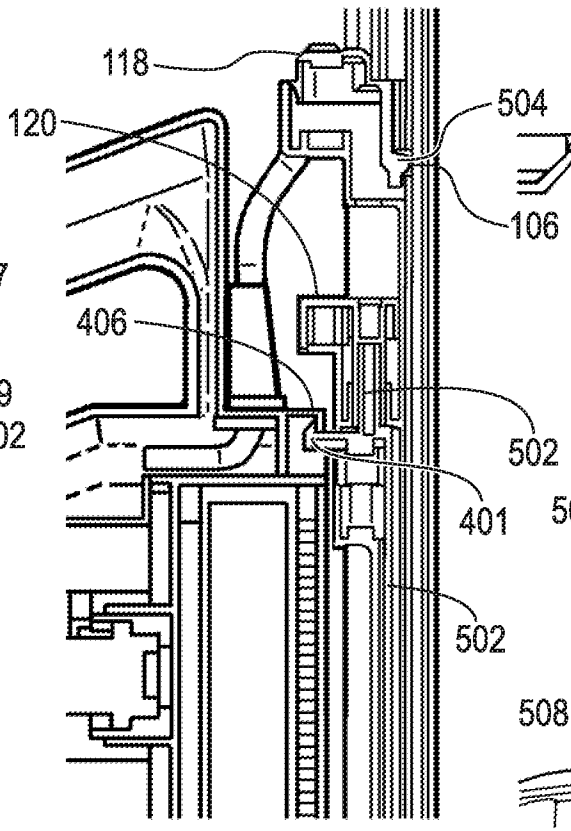
Figure 5A:
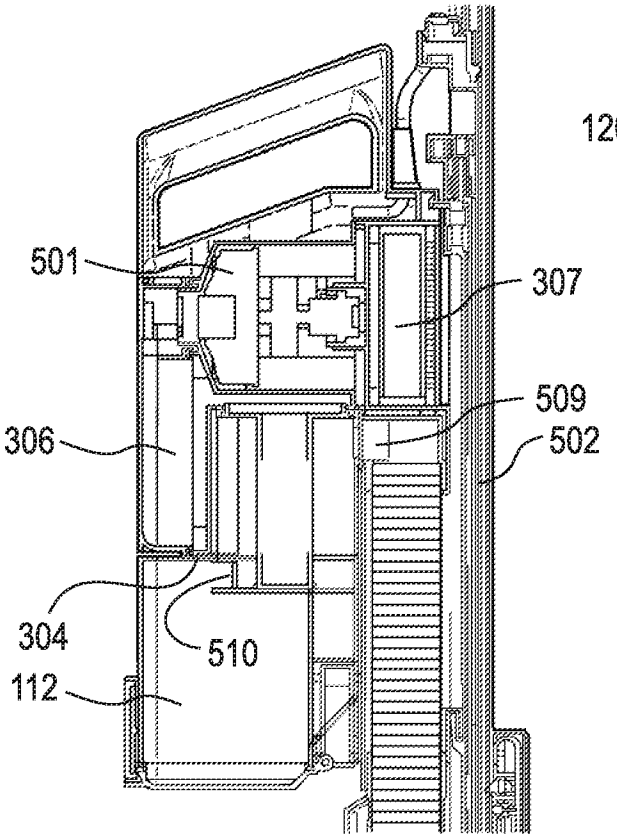

Referring to FIG. 5A, a sample layout of the various vacuum module 108 components (e.g., motor 501, filters 306 and 307, dust cup 112, and cyclone chamber 304) is depicted for illustrative purposes. Those of ordinary skill in the art will appreciate that various arrangements and implementations are possible.

Referring to FIG. 5B, the lever or button 118 can include an extension or prong 504 that can be inserted into a selected slot 106 on frame rail 104 to secure rail guide mechanism 405 and vacuum module 108 in place. To move the vacuum module 108 to another position on the frame rail 104, the lever or button 118 can be utilized to disengage the extension or prong 504 from the slot 106. The vacuum module 108 and rail guide mechanism 405 can then be slid to another preferred slot 106 on frame rail 104, and secured in place by engaging lever or button 118 as above.

Referring to FIGS. 5A-5C and FIGS. 4A-4C, the lever or button 120 can be coupled to one end of a rigid member or rod 502 that can extend the entire length of and be located within the rail guide mechanism 405. The rod 502 can be affixed to the catch 401 of the rail guide mechanism 405. Catch 401 can be interlocked with catch 406 of the vacuum module 108 (and catch 403 can be interlocked with catch 404) when the vacuum module 108 is attached to the rail guide mechanism 405. To disengage the interlocked catches (i.e., catches 401, 406 and 403, 404) and release the vacuum module 108, button 120 can be manually depressed, forcing a rod 502 and catch 401 downward and away from catch 406, thereby releasing the upper portion of the vacuum module 108 from the rail guide mechanism 405 (see FIG. 5B). Moreover, when the button 120 is manually depressed, an opposite end 505 of rod 502 is forced downward and against a slanted extension 506 that is affixed to catch 402 thereby forcing catch 402 to retract away from and release the expandable hose 208. A user can then grasp the vacuum module handle 110 and pull to disengage interlocked catches 403 and 404, thereby releasing the vacuum module 108 entirely (see FIGS. 5A and 5C) in a controlled manner. In this embodiment, the vacuum module 108 can be detached from the rail guide mechanism 405 when the vacuum module 108 is in the lowered position (i.e., upright vacuum) with the expandable hose 208 retracted into the vacuum module 108. Other design options and release mechanisms are available in various embodiments.

Figure 1B:
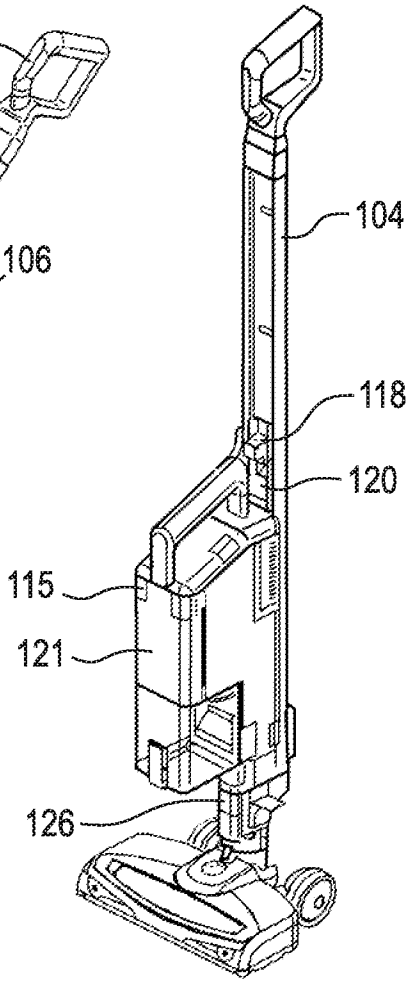
Figure 1A:
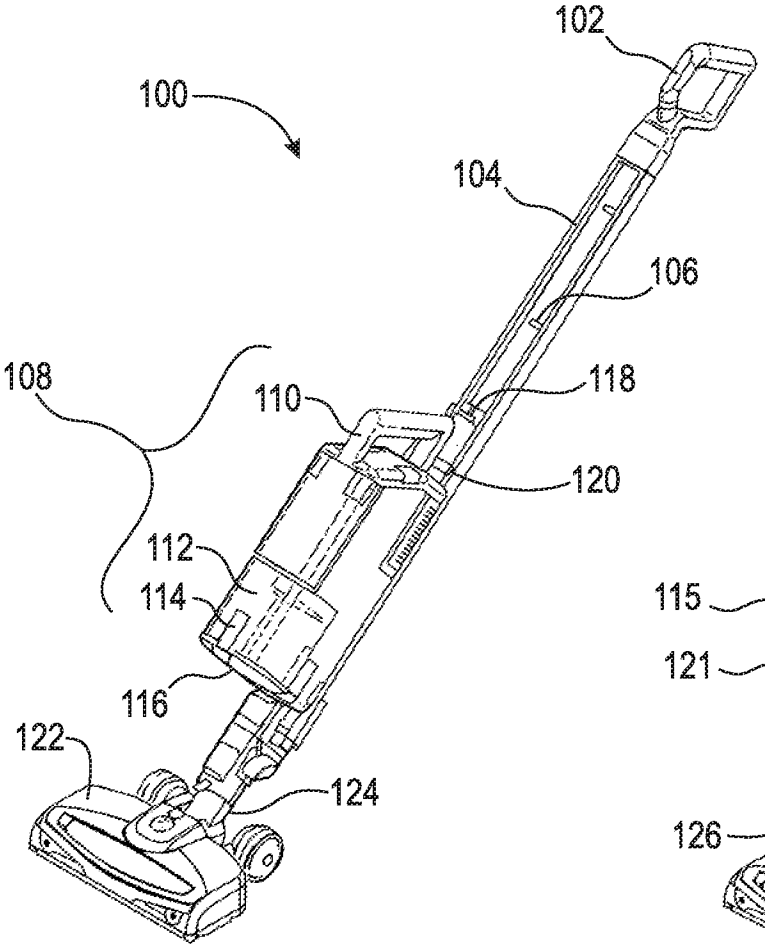
Figures 2A, 2B, 2C, 2D:
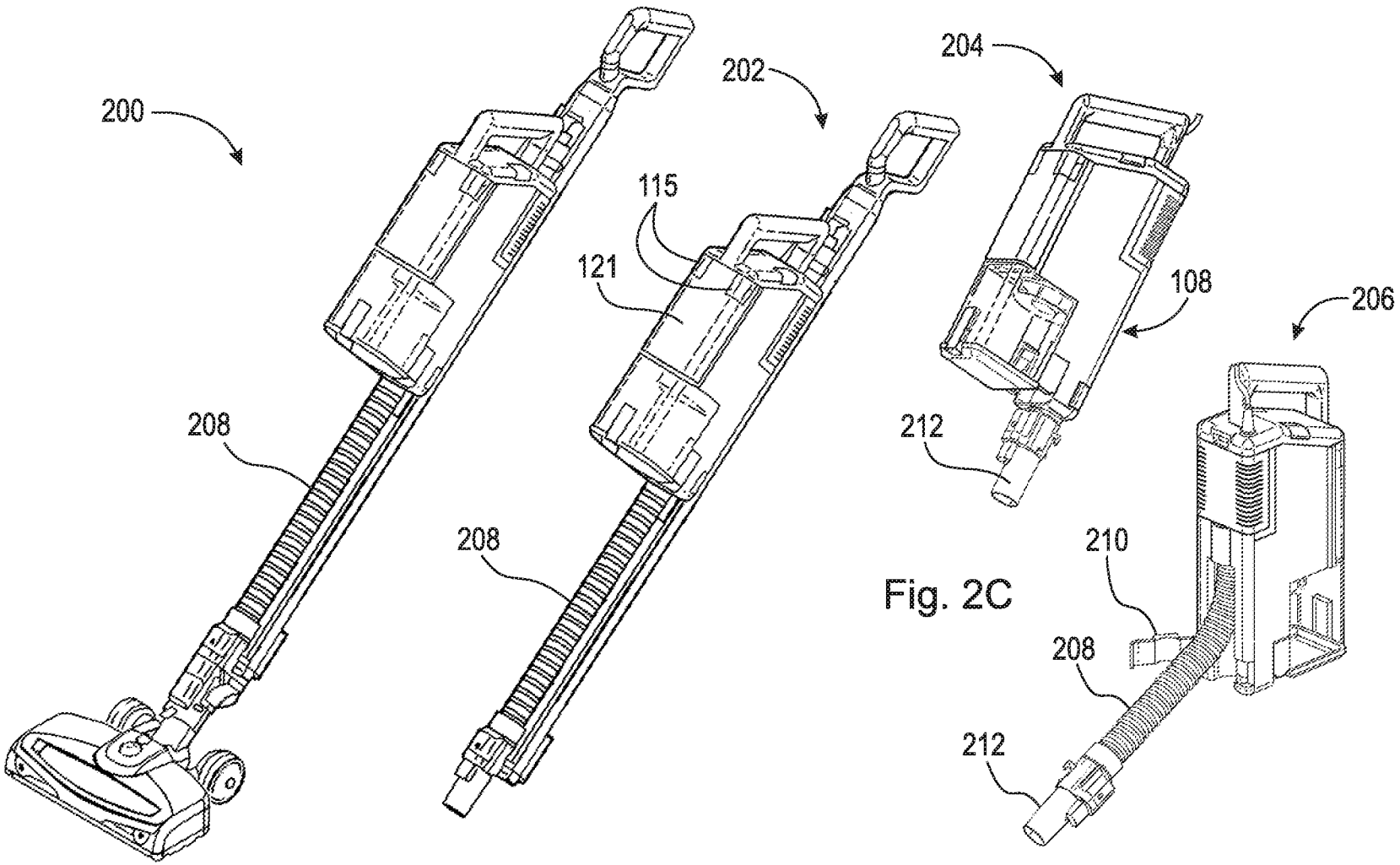
FIGS. 2A-D are diagrams of the embodiment of FIGS. 1A-D in alternative modes of operation.

Referring to FIGS. 1B and 5C, in an embodiment, the nozzle neck 126 can include an electrical connector 507 to transfer power from an electrified expandable hose 208 to a floor nozzle 122 and associated components (e.g., brushroll, headlights). The nozzle neck 126 can also include a locking mechanism 508 that locks the nozzle neck 126 and nozzle 122 into a static position to prevent movement and facilitate the vacuum cleaner 100 staying upright.

Figure 5D:
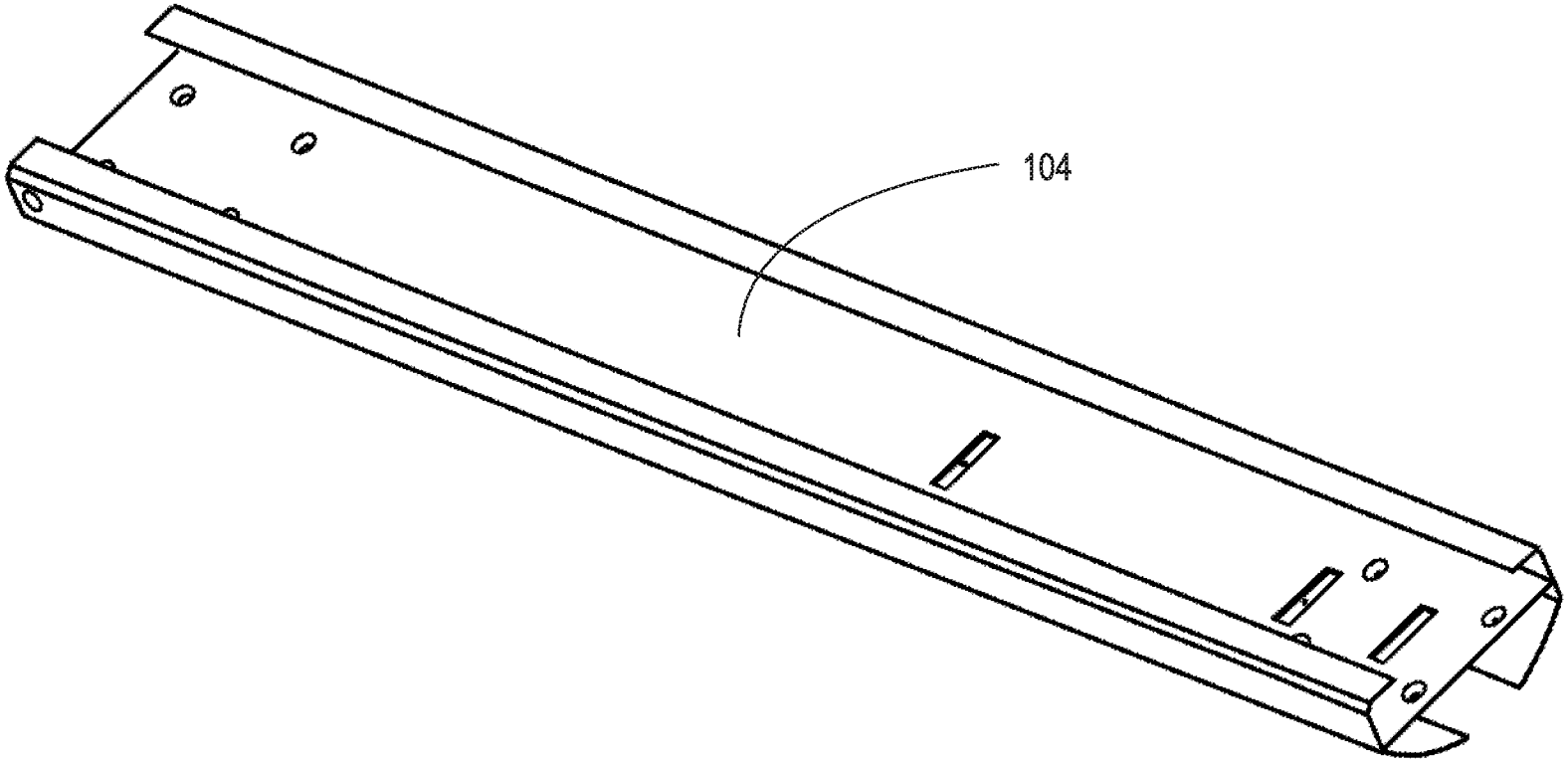
Figure 5E:
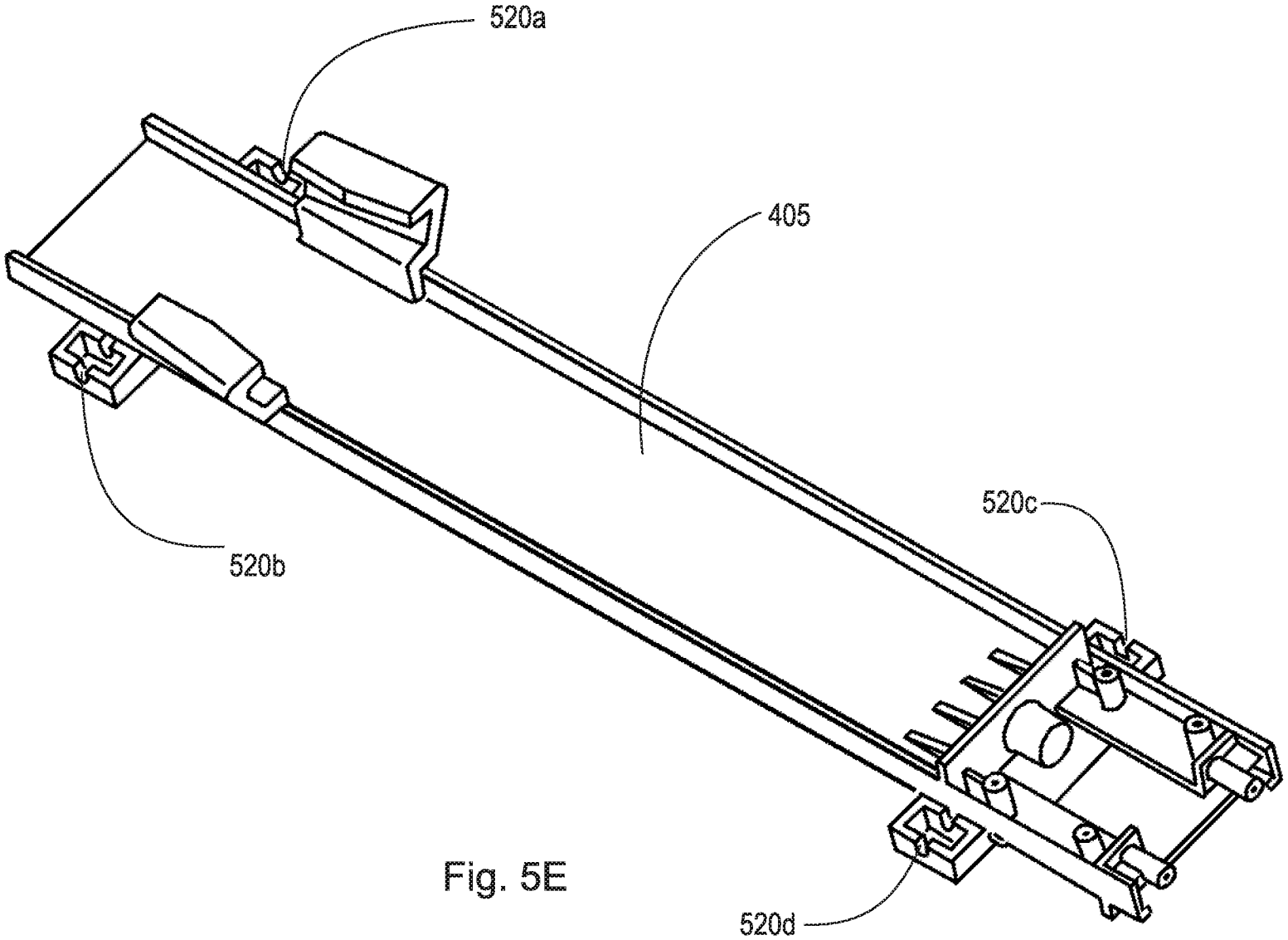
Figure 5F:
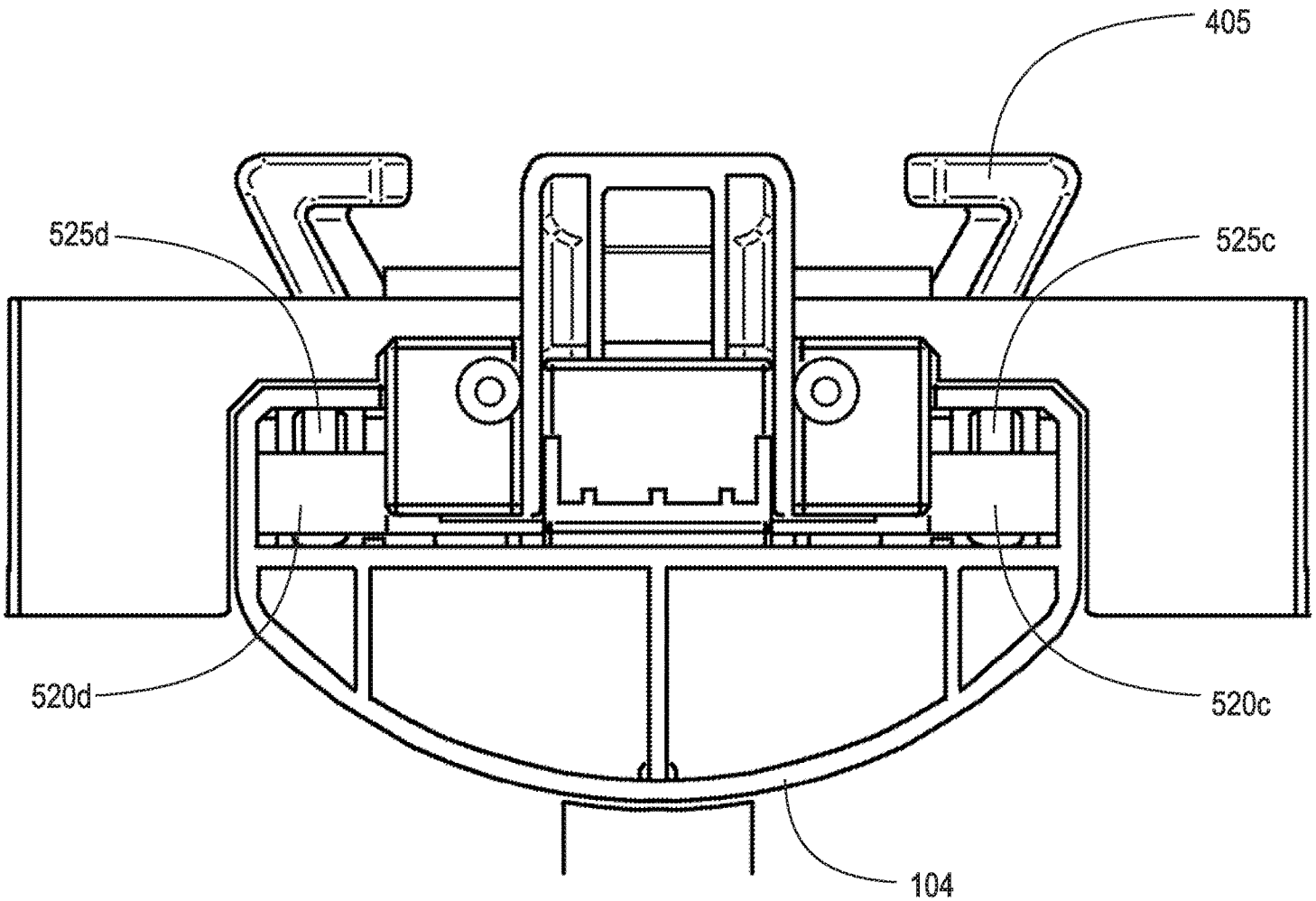
Figure 5G:
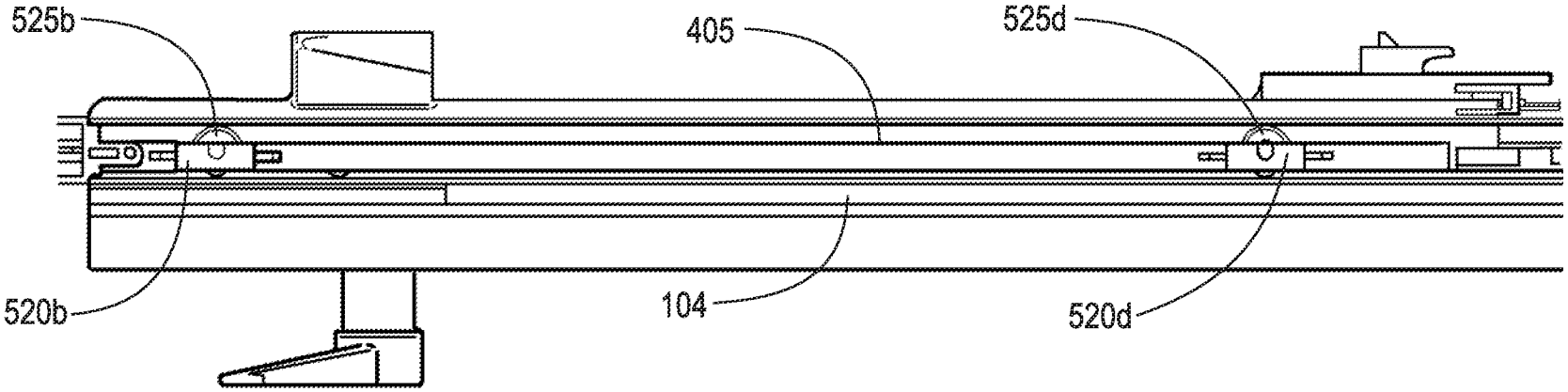

FIGS. 5D-G illustrate example components of the frame rail 104 and rail guide mechanism 405 described above. FIG. 5D illustrates the example frame rail component 104, and FIG. 5E illustrates the example rail guide mechanism component 405. The example rail guide mechanism 405 includes four brackets to hold four wheels (not shown) to enable smooth sliding of the rail guide mechanism 405 along the frame rail 104. FIG. 5F is a cross-sectional diagram illustrating the frame rail 104 and rail guide mechanism 405 viewed along their long axes. Two wheels 525*c* and 525*d* are shown inside brackets 520*c* and 520*d*. FIG. 5G is a cross-sectional diagram illustrating the frame rail 104 and rail guide mechanism 405 viewed perpendicular to their long axes. Two wheels 525*b* and 525*d* are shown inside brackets 520*b* and 520*d*. In alternative embodiments, components other than wheels may be used, such as, for example, ball bearings. In still other embodiments, the rail guide mechanism 405 can slide along the frame rail 104 without the aid of wheels or ball bearings.

Figure 6A:
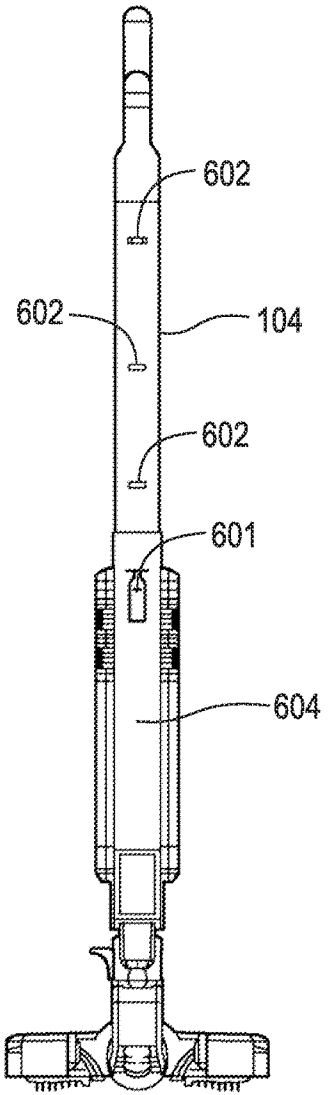
FIGS. 6A-C are diagrams of another example embodiment of a vacuum cleaner having an adjustable length elongated support member.
Figure 6B:
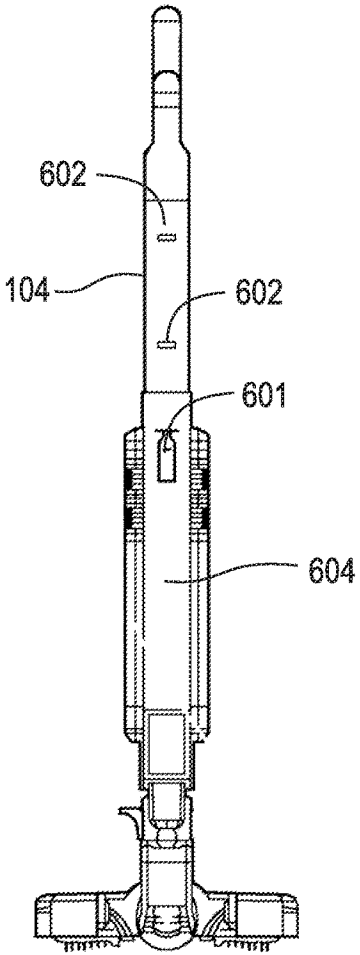
Figure 6C:
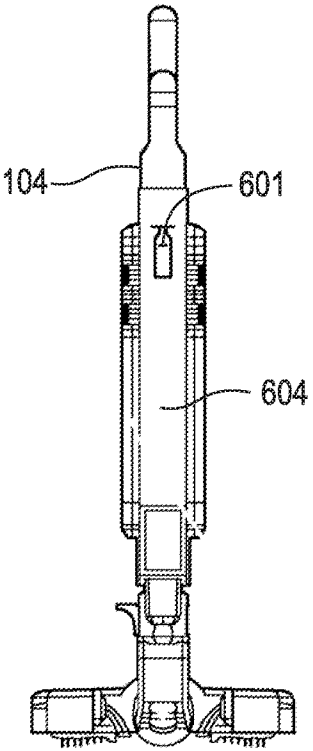

Referring to FIGS. 6A-6C, in an example embodiment, the frame rail 104 can be adjustable in length to facilitate use of the vacuum cleaner 100. The frame rail 104 can include a lower portion 604 that acts like a sheath into which the upper portion of frame rail 104 can be retracted. A surface of the upper portion of frame rail 104 can include one or more indentations or slots 602, and the lower portion 604 can include a catch 601 that can be used to selectively adjust the length of frame rail 104 by inserting the catch 601 into a selected slot 602 thereby temporarily locking the frame rail 104 in place at a particular length.

Figure 7:
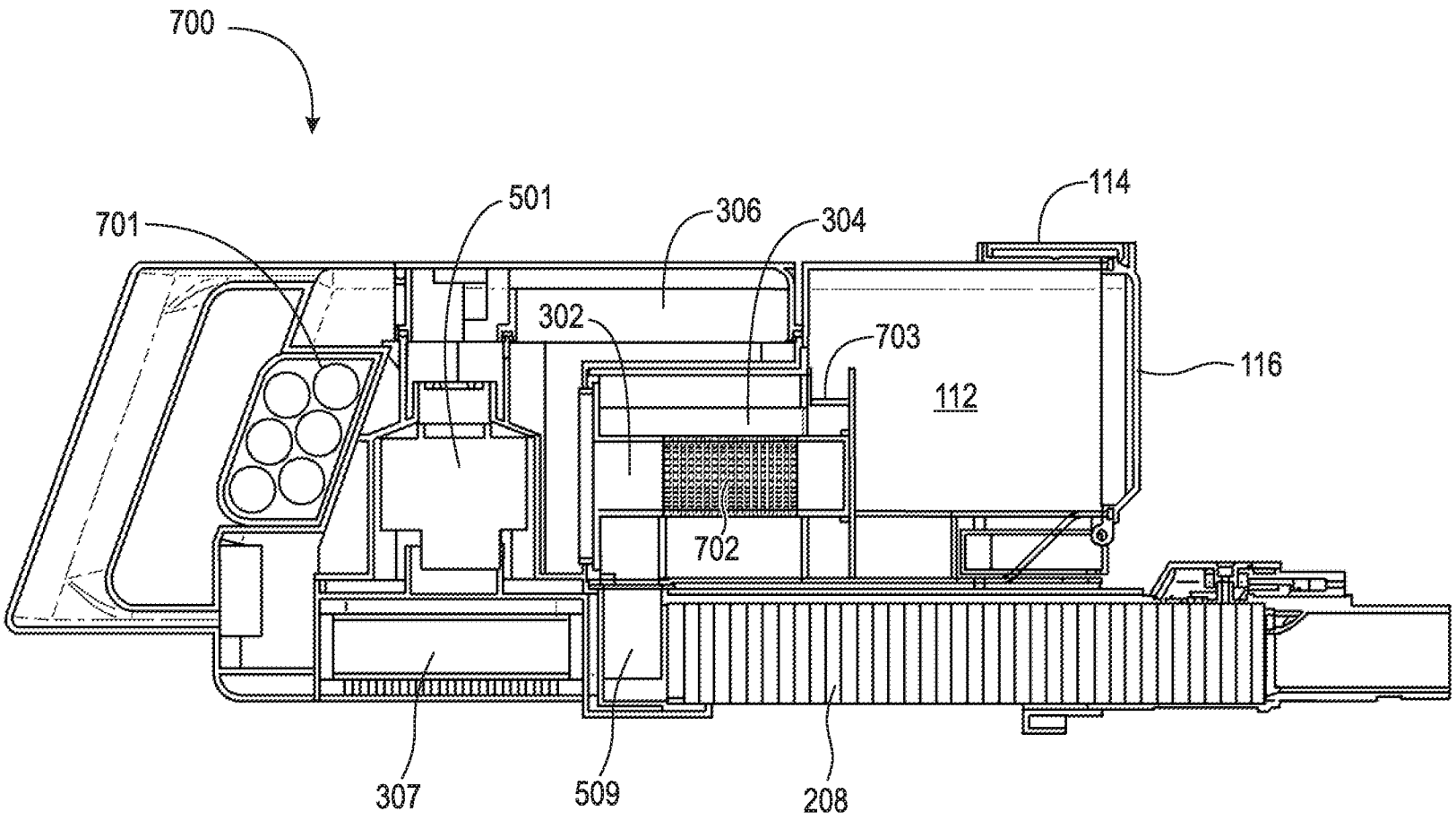
FIG. 7 is a cross-sectional diagram of an example embodiment that employs a battery pack.

Referring to FIG. 7, in an example embodiment 700, the vacuum module 108 can be configured as a cordless vacuum (e.g., handheld vacuum) by including a battery pack 701. A suction motor 501 generates the suction power to drive the airflow through the vacuum module 108. One or more filters (e.g., HEPA filters) can be included to remove fine dirt and dust particles from an introduced dirty air flow. For example, pre-motor filter 306 and post-motor filter 307 can be positioned before and after the motor 501 to remove fine dirt and dust particles. In FIG. 7, the air treatment unit 304 is depicted as a horizontally positioned single cyclone chamber for illustrative purposes; however, the air treatment unit 304 can alternatively be a horizontally or vertically positioned single cyclone, dual cyclone, multi-cyclone, or any other type of air treatment or filtration unit, in which case, the air treatment chamber 304 may be interchangeably referred to as a cyclone chamber 304. The depicted single cyclone chamber 304 includes a vortex finder 302 having multiple perforations 702 that allow air flow and fine particulates to pass through the perforations 702 and exit the top of the cyclone chamber 304. Larger dirt particles fall to the bottom of the cyclone chamber 304 and through one or more openings 703 into the dust cup 112. The dust cup 112 includes a latch 114 that keeps the dust cup door 116 closed and the latch 114 can be used to open dust cup door 116 to empty the dust cup 112 when necessary. In some embodiments, the flexible hose 208 may be electrified by embedding wires or conductive material within the hose 208 (e.g., along the ribs of the hose) or along the exterior of hose 208. An electrified hose 208 can be useful for powering the floor nozzle 122 and any of its components, such as a brushroll or headlights. The top of the flexible hose 208 is coupled to a connector having an aperture 509 that is aligned with an opening in the cyclone chamber 304, so that an introduced dirty fluid flow can tangentially enter the cyclone chamber 304, thereby ensuring that the fluid flow spirals about the vortex finder 302. The corresponding opening in the cyclone chamber 304 is illustrated in FIG. 3B.

Figure 8:
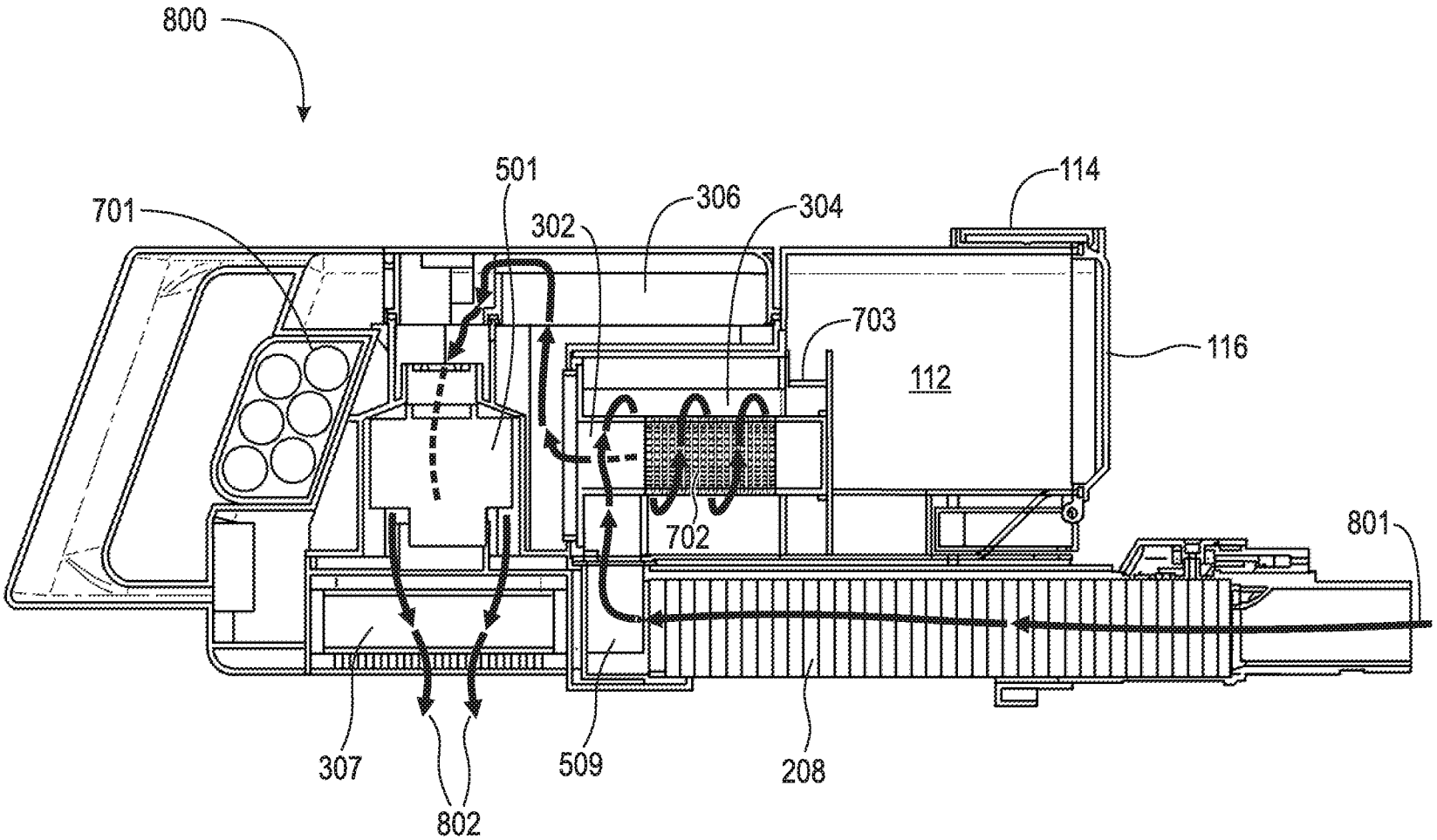
FIG. 8 is a cross-sectional diagram illustrating air flow through the vacuum module of an example embodiment.

Referring to FIG. 8, in one embodiment 800, the airflow path through the example vacuum module 108 during runtime operation is illustrated. In operation, the suction motor 501 creates a suction force that forces a dirty fluid flow (e.g., air with debris) 801 into and through the hose 208. The dirty fluid 801 enters the cyclone chamber 304 tangentially through the aperture 509, and swiftly spirals around the vortex finder 302. Perforations 702 (which can be configured as a mesh) located on the vortex finder 302 separate dirt particles and debris from the fluid 801 by preventing larger dirt particles from passing through smaller-diameter perforations 702. Instead, the larger dirt particles and debris fall to the bottom of the cyclone chamber 304 and through an opening 703 into the dust cup 112. The partially cleaned fluid that passes through the perforations 702 is forced up through the vortex finder 302 and exits the top of cyclone chamber 304. The partially cleaned fluid then proceeds through pre-motor filter 306 where additional dirt particles are removed. The partially cleaned fluid is then pulled through motor 501 and forced through post-motor filter (e.g., HEPA filter) 307 to remove any remaining fine dirt particles. Clean fluid 802 then exits the vacuum module 108.

Instead of a frame rail, the elongated support member may, alternatively, be configured with a collar (not shown) that couples the vacuum module 108 to a pole without a slot of the frame rail 104. Instead, complementary elements of a detent (e.g., spring-loaded ball bearings and hole features) may be employed on the collar and pole, respectively, to retain the vacuum module 108 at selected locations along the pole of the vacuum cleaner 100 to provide an equivalent repositioning function of the vacuum module 108 as disclosed in reference to the embodiment of FIGS. 1A-1D or other forms of mechanical elements that provide similar functionality. The vacuum module 108 can be decoupled from the collar, in such an embodiment, in a manner similar to the decoupling of the vacuum module 108 from the rail guide mechanism 405 to enable a handheld mode of operation.

While example embodiments have been particularly shown and described, it will be understood by those skilled in the art that various changes in form and details may be made therein without departing from the scope of the embodiments encompassed by the appended claims. For example, the elongated support member can take forms different from the frame rail shown in the embodiment of FIGS. 1A-D or the pole with collar embodiment described above. Further, the vacuum module may be mounted on either an upper surface or a lower surface of the elongated support member, and the vacuum module and elongated support member can be configured to have any number of positions at which the vacuum module can be positioned along the elongated support member. In one example embodiment, the vacuum module can be configured with a clamping mechanism that allows a user to position the vacuum module at any arbitrary position along the elongated support member.

What is claimed is:

1. A surface cleaning apparatus comprising:
an elongated support member;
a handle coupled to an upper end of the elongated support member;
a vacuum module slidably and detachably coupled to the elongated support member; and
a hose coupled to the vacuum module and expandable to accommodate lower and upper positions of the vacuum module along the elongated support member.

2. A surface cleaning apparatus as in claim 1 further comprising a floor nozzle detachably coupled to a lower end of the elongated support member and the hose.

3. A surface cleaning apparatus as in claim 2 wherein the hose includes a conductive wire configured to power the floor nozzle.

4. A surface cleaning apparatus as in claim 3 wherein the conductive wire is embedded in the hose.

5. A surface cleaning apparatus as in claim 3 wherein the floor nozzle includes a neck that includes an electrical connector to connect to the conductive wire of the hose.

6. A surface cleaning apparatus as in claim 1 wherein the elongated support member is extendable and retractable.

7. A surface cleaning apparatus as in claim 1 wherein the vacuum module includes a receptacle configured to retain the hose when the hose is retracted.

8. A surface cleaning apparatus as in claim 7 wherein the hose is retracted and retained within the receptacle of the vacuum module when the vacuum module is configured in its lowest position along the elongated support member.

9. A surface cleaning apparatus as in claim 7 wherein the hose is retracted and retained within the receptacle of the vacuum module when the vacuum module is detached from the elongated support member and the apparatus is in a handheld vacuum configuration.

10. A surface cleaning apparatus as in claim 1 wherein the vacuum module is detached from the elongated support member and the hose is expanded when the apparatus is in a pod vacuum configuration.

11. A surface cleaning apparatus as in claim 1 wherein the vacuum module is coupled to an upper surface of the elongated support member.

12. A surface cleaning apparatus as in claim 1 wherein the elongated support member includes a frame rail, and wherein the frame rail and vacuum module include complementary features that enable the vacuum module to couple to the frame rail.

13. A surface cleaning apparatus as in claim 12 wherein the frame rail and vacuum module include further complementary features to enable positioning of the vacuum module at different locations along the frame rail.

14. A surface cleaning apparatus as in claim 12 wherein the frame rail includes a track and a rail guide mechanism slidably disposed within the track, and wherein the rail guide mechanism and vacuum module include complementary features to enable the vacuum module to couple to the rail guide mechanism in a manner that does not restrict the rail guide mechanism from being capable of sliding within the track.

15. A surface cleaning apparatus as in claim 14 wherein the track and rail guide mechanism include complementary features that enable the rail guide mechanism to be fixedly positioned at multiple locations along the track.

16. A surface cleaning apparatus as in claim 1 further comprising a collar assembly coupled to the elongated support member and including at least one feature that enables the vacuum module to couple to the collar assembly.

17. A surface cleaning apparatus as in claim 16 wherein the elongated support member and collar assembly include complementary positioning features that enable the collar assembly to be fixedly positioned at multiple locations along the elongated support member.

18. A surface cleaning apparatus as in claim 1 wherein the vacuum module includes a handle, air treatment unit, dust cup, suction motor, filter, cyclone chamber, and hose interface, and wherein the vacuum module further includes a mechanism that enables the vacuum module to be attachable and detachable from the elongated support member or interface element coupled to the elongated support member.

19. A cleaning apparatus comprising:

an elongated support member;

a handle configured to be coupled to the elongated support member;

a vacuum module configured to be slidably coupled to the elongated support member; and a hose configured to be coupled to the vacuum module and expandable to accommodate different positions of the vacuum module along the elongated support member.

20. A cleaning apparatus comprising:

(i) a support structure including:

an elongated support member;

a handle coupled to an upper end of the elongated support member, and a floor nozzle pivotably coupled to a lower end of the elongated support member, the floor nozzle having a dirty air inlet and a dirty air outlet; and (ii) a vacuum module slidably and detachably coupled to the elongated support member, the vacuum module including:

an air path including a dirty air inlet cuff, a flexible air conduit hose, an air treatment member, a suction motor, and a clean air outlet, the air path configured to attach to the dirty air outlet of the floor nozzle; and a body including a handle and configured to attach to the support structure;

wherein the dirty air inlet cuff is attached to the floor nozzle, and the flexible air conduit hose extends to the body of the vacuum module.

21. A cleaning apparatus as in claim 20 wherein, when the vacuum module is attached to the support structure, the floor nozzle dirty air outlet is fluidly connected to the vacuum module dirty air inlet cuff.

22. A cleaning apparatus as in claim 20 wherein, when the vacuum module is detached from the support structure, the vacuum module is operable as a handheld vacuum and the dirty air inlet cuff of the air path is configured to couple with accessory tools.

23. A cleaning apparatus as in claim 20 wherein the cleaning apparatus is operable as a pod vacuum with the flexible air conduit hose when the vacuum module is detached from the support structure.

* * * * *